United States Patent [19]

Bowsky et al.

[11] Patent Number: 4,461,925

[45] Date of Patent: Jul. 24, 1984

[54] HERMETIC REFRIGERATION TERMINAL

[75] Inventors: Benjamin Bowsky; Glenn A. Honkamp, both of Warren County, Ohio

[73] Assignee: Emerson Electric Co., St. Louis, Mo.

[21] Appl. No.: 298,010

[22] Filed: Aug. 31, 1981

[51] Int. Cl.[3] ..... H01B 17/30; H01R 13/74

[52] U.S. Cl. ..... 174/152 GM; 339/192 RL

[58] Field of Search ..... 174/50.58, 50.61, 50.63, 174/151, 152 R, 152 GM, 153 R; 339/192 RL

[56] References Cited

U.S. PATENT DOCUMENTS

| | | | |
|---|---|---|---|
| 1,546,855 | 7/1925 | Montsinger | 174/153 R X |
| 3,551,191 | 12/1970 | Elbling et al. | 174/152 GM X |
| 3,637,917 | 1/1972 | Oates | 174/152 GM |
| 3,784,733 | 1/1974 | Farmer et al. | 174/153 R |
| 4,103,416 | 8/1978 | Sakamoto | 174/152 GM X |
| 4,296,275 | 10/1981 | Bowsky | 339/192 RL X |

FOREIGN PATENT DOCUMENTS

| | | | |
|---|---|---|---|
| 1092083 | 11/1960 | Fed. Rep. of Germany | 174/152 GM |
| 1100126 | 2/1961 | Fed. Rep. of Germany | 174/152 GM |
| 868638 | 10/1941 | France | 174/152 GM |
| 1474348 | 2/1967 | France | 174/152 GM |
| 1006929 | 10/1965 | United Kingdom | 174/152 GM |

*Primary Examiner*—Laramie E. Askin

*Attorney, Agent, or Firm*—Polster, Polster and Lucchesi

[57] ABSTRACT

In various embodiments of improvements in a hermetic refrigeration terminal of the type shown and described in U.S. Pat. No. 4,296,275, the flange of the current conducting pin is made non-circular, the pin is necked with a circumferential groove or, in the area in which it passes through the seal, is enlarged, or both, and, when a plurality of openings is provided in the bottom wall of the cup-shaped body of the terminal, a corresponding number of insulating sleeves are joined by a common web or spider, which may be provided with a zone of weakness or may be made flexible as compared with a rigid ceramic web, for example. In still other embodiments, a pin is made up of a core structure of copper or other highly electrically conductive material and a tube, of steel or other material compatible with the seal material, that extends through the reach of the seal, the tube being hermetically secured to the core structure. The flange is either provided on the core structure itself or on the tube.

9 Claims, 28 Drawing Figures

HERMETIC REFRIGERATION TERMINAL

BACKGROUND OF THE INVENTION

This invention has to do with variations on the construction of some of the elements of Bowsky application Ser. No. 157,411, filed June 9, 1980, now U.S. Pat No. 4,296,275. In the device shown and described in that application, a pin with a flange and a straight shank is used by way of illustration. Each pin is surrounded by an individual sleeve. It is sometimes desirable to orient the pin in a particular way with respect to its sleeve, and to that end, in one embodiment of the present invention, various non-circular flanges, seating in complementarily shaped seats in the sleeve, are provided. As is indicated in the Bowsky patent, safety and reliability are key considerations in the design of the device of this invention. In one embodiment of this invention, a pin of steel is coated with copper or other highly electrically conductive metal, except along an axial reach through which the pin is bonded to the lip defining an opening in the cup-shaped body of a hermetic refrigeration terminal. That reach is enlarged in transverse cross-section to increase the conductive capacity of the pin through at least the unplated axial reach of the pin. In another embodiment, a core structure of copper or other highly electrically conductive material is encased through at least the axial reach of the pin in which the pin is to be bonded to the seal in, and hermetically secured to a tube of steel or other metal to which the seal bonds readily and permanently. The tube can be flanged at its inner end to provide the flange for the pin, the tube being of material stronger in shear than the core structure. In still another embodiment, the pin is necked to form in effect a fuse area, so that if excessive heating of the pin occurs, the pin will fail (burn off), and thereby protect both the hermetic motor, and persons in the vicinity. In assembling terminals of this invention, wherein more than one opening is provided in the cup (commonly, three), provision is made in still other embodiments for the joining of the sleeves with a common web to facilitate manufacture. However, because the coefficients of expansion of the cup and a ceramic web are likely to be substantially different, provision is made in some embodiments for accommodating that difference.

One of the objects of this invention is to provide a hermetic refrigeration terminal that is easier to assemble, more efficient, and safer than such terminals known heretofore.

Other objects will become apparent to those skilled in the art in the light of the following description and accompanying drawing.

SUMMARY OF THE INVENTION

In accordance with this invention, generally stated, a hermetic refrigeration terminal of the type shown and described in Bowsky application Ser. No. 157,411, now U.S. Pat. No. 4,296,275, is provided in which, in various embodiments of the invention, the flange of the terminal pin is made non-circular, the pin is necked with a circumferential groove or, in the area in which it passes through the seal, is enlarged, or both, or a core structure of highly electrically conductive material is encased through a part of its length with a tube of material, hermetically secured to the pin, that can be bonded successfully to the seal. In other embodiments, when a number of openings are provided in the cup of the terminal, a corresponding number of insulating sleeves are joined by a common web or spider in such a way as to position each sleeve in its proper place with respect to an opening and, when the pin flange and sleeve seat are non-circular, to position each pin in proper orientation, which web or spider, in other embodiments, is provided with zones of weakness or flexibility.

DESCRIPTION OF THE PREFERRED EMBODIMENT

Figure 19:
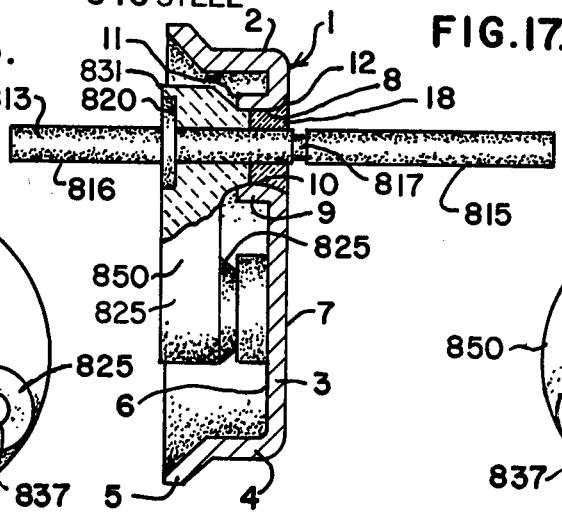
FIG. 19 is a view, partly in section and partly broken away, of a hermetic refrigeration terminal employing the unitary seal and web assembly of FIG. 18.

Referring now to the drawing, and particularly to FIG. 19, reference numeral 1 indicates an assembled hermetic refrigeration terminal having a cup-shaped body 2, with a generally flat bottom 3, and a side wall 4 with an outwardly flaring rim 5. The bottom 3 has a dish side surface 6 and an outside surface 7, and at least one opening 8 defined by an annular lip 9 with an inside wall surface 10, a free edge 11 on the dish side and a radius 12 on the outside. These elements are common to all the embodiments shown and described. All of the embodiments also include a current carrying pin, an electrically insulating sleeve, and a seal by which the pin and sleeve are bonded to the inside surface of the lip and to one another.

Figure 1:
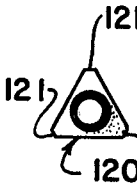
FIG. 1 is a view in end elevation of a current carrying pin of one embodiment of a hermetic refrigeration terminal of this invention.
Figure 2:
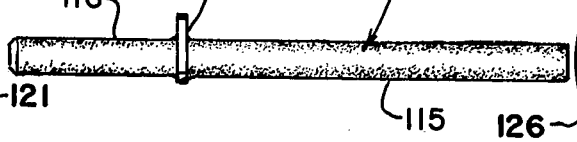
FIG. 2 is a view in side elevation of the pin of FIG. 1.

Referring to FIGS. 1 and 2, a current-carrying pin 113 with an outer end 115 and an inner end 116, has intermediate its ends a flange 120, which in this embodiment is integral with the pin. The flange 120 is triangular in end view, as shown in FIG. 1, with rounded apices 121, and in side elevation, has parallel side surfaces, extending radially perpendicularly to the pin. The pin is otherwise uniformly cylindrical, and the flange is arranged symmetrically about the center axis of the pin. A sleeve 125, shown in FIGS. 3 and 4, has an outside wall 126, a tapered part 129, a cylindrical upper part 130 constituted by the outer surface of a rim 131, a stepped lower cylindrical part or nose 132, and a cylindrical bore 137 extending axially through the sleeve along the center line of the sleeve. By way of illustration, all of the sleeves shown in connection with the various embodiments of pins have the same kind of bore and external configuration, and these parts will not be identified by reference numerals in those other embodiments. As is evident from the descriptions of sleeves in U.S. Pat. No. 4,296,257, the sleeves can have various configurations. All of the sleeves also have a seat, but the configuration of the seat differs with the various configurations of flanges described. In the embodiment of sleeve shown in FIGS. 3 and 4, a seat 133, defined by a flat surface 135 and an inside wall 136 of the rim 131, is shaped complementarily to the configuration of the flange 120. The seat is of a size closely to receive the flange 120, and the bore 137, closely to receive the end 115 of the pin. The pin 113 and sleeve 125 are mounted in a body and bonded to the body by a seal as described heretofore and in U.S. Pat. No. 4,296,275.

Figure 5:
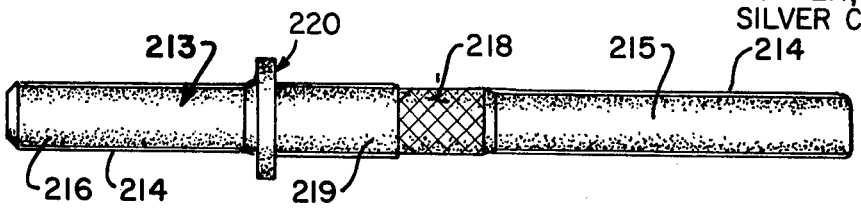
FIG. 5 is a view in side elevation of a current carrying pin of another embodiment.
Figure 6:
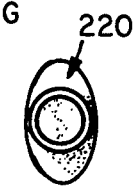
FIG. 6 is a view in end elevation of the pin of FIG. 5.

In FIGS. 5 and 6, a pin 213 is shown which differs from the pin of FIGS. 1 and 2 in several respects. First, it is provided with a flange 220, intermediate an inner end 216 and an outer end 215, that is oval in end view, and fits closely into a seat, shaped and sized complementarily to the flange, in a sleeve, not here shown. Second, the pin has an enlarged section 219 extending from the flange 220 in the direction of the outer end 215 through the length of the axial reach of the pin through which the seal extends. Third, the pin is provided with a coating 214 of a material such as metallic copper, gold or silver, that is more electrically conductive or a material that is more corrosion resistant, or both, than the material of which the pin is made, through the entire reach of the inner end 216 to the flange, and through the reach of the outer end 215 to an uncoated area 218 that extends through the axial reach of the seal when the pin is sealed to a body. The pin in this embodiment is made of steel with a coefficient of expansion sufficiently close to that of the seal material to permit permanent bonding of the two. The material of the coating in this illustrative embodiment is copper, which cannot be bonded successfully to a glass that can also be bonded to the body.

Figure 7:
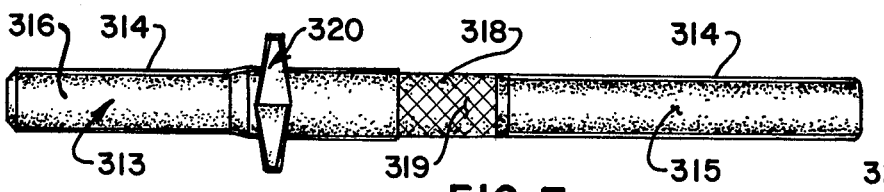
FIG. 7 is a view in side elevation of a pin of another embodiment.
Figure 8:
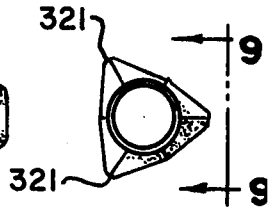
FIG. 8 is a view in end elevation of the pin of FIG. 7.
Figure 9:
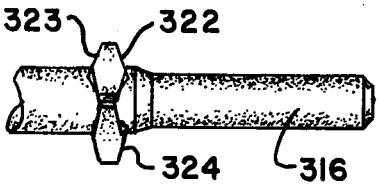
FIG. 9 is a fragmentary view in side elevation of the pin of FIGS. 7 and 8, viewed along the line 9—9 of FIG. 8.
Figure 11:
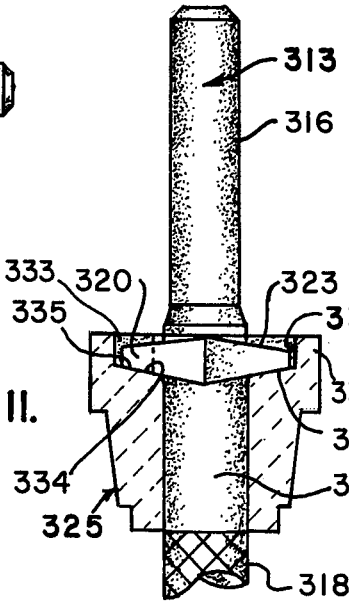
FIG. 11 is a fragmentary sectional view taken along the line 11—11 of FIG. 10.
Figure 10:
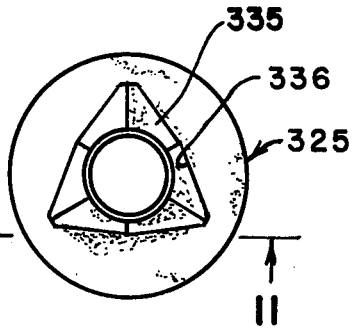
FIG. 10 is a view in end elevation of the pin of FIGS. 7–9 mounted in an insulating sleeve with a seat complementary to the flange of the pin of FIGS. 7–9.

In FIGS. 7–11, a pin 313 and sleeve 325 are provided that are easily assembled in a predetermined orientation with respect to one another. The pin 313, with an outer end 315 and an inner end 316, is provided with a flange 320 that is triangular in end view as shown in FIG. 8, with rounded apices 321, and prismatic, or truncated diamond shaped in side elevation along each of the sides of the triangle, as shown in FIGS. 7 and 9. A sleeve 325 is provided with a seat 333 defined by an inside wall 336 of a rim 331 and a bottom surface 335 in the form of a trough-defining area 334 complementary to the prismatic surfaces 322 and 324 of the flange, by which the pin is oriented with respect to the sleeve when the flange seats in it. For manufacturing purposes, the flange 320 has prismatic surfaces 323, mirror images of surfaces 322 and 324, on its inner side. The pin 313 is also shown as being provided with a coating or layer 314 of conductive material, an uncoated area 318 and an enlarged section 319 corresponding to those areas on the pin of FIG. 5.

Figure 12:
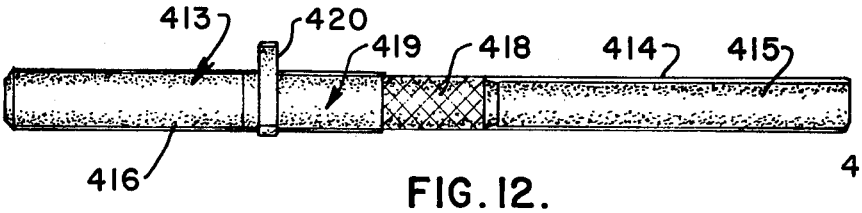
FIG. 12 is a view in side elevation of a pin of still another embodiment.
Figure 13:
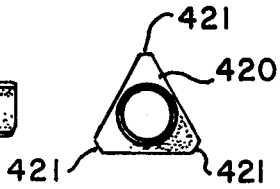
FIG. 13 is a view in end elevation of the pin of FIG. 12.

A pin 413 shown in FIG. 12 has a flange 420 with apices 421, similar to the flange 120 of the pin of FIGS. 1 and 2, and an inner end 416, outer end 415, unplated area 418, enlarged section 419 and layer 414 similar to that of the pins shown in FIGS. 5 and 7.

Figure 14:
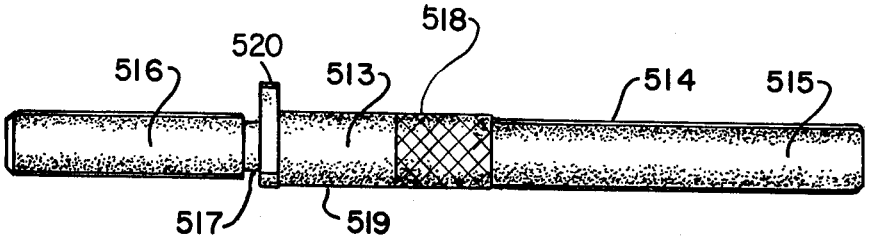
FIG. 14 is a view in side elevation of a pin of still another embodiment.
Figure 15:
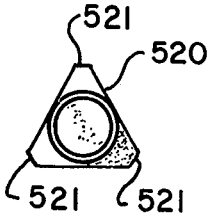
FIG. 15 is a view in end elevation of the pin of FIG. 14.

In FIGS. 14 and 15, a pin similar to that shown in FIG. 12, with a flange 520, apices 521, inner end 516, outer end 515, layer 514, enlarged section 519, and uncoated area 518, is provided with a reduced cylindrical neck 517, coaxial with the rest of the cylindrical part of the pin, lying closely adjacent the flange 520 on the side of the flange facing the inner end 516 of the pin. The neck provides an area of predeterminedly increased electrical resistance, and so serves as a fuse under extreme overload conditions, burning through within the hermetic casing in which the terminal is mounted. It can also serve as a resistor, limiting the amount of current carried to the motor or other electrical device within the hermetic shell in and through which the terminal is mounted.

Figure 16:
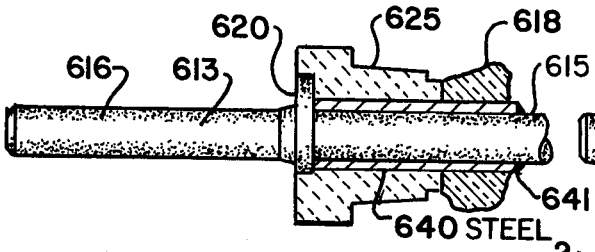
FIG. 16 is a fragmentary view, partly in longitudinal section, of a pin, sleeve and seal of still another embodiment.

A pin 613 illustrated in FIG. 16, is made up of a core structure made of copper or other highly electrically conductive metal that is not suitable for direct bonding to the usual seal material such as glass, because of the extreme differences in coefficient of expansion between the two, and a tube 640 of steel or other material that is more nearly compatible with the seal. In this embodiment, the core structure of the pin 613 has substantially the same configuration as the pin of FIGS. 1–2, of uniform diameter except on the inside side of a triangular flange 620, integral with the core structure, where the swaging produces a small collar. The pin has the usual outer end 615 and inner end 616. The straight cylindrical tube 640 of steel or other material more nearly compatible with the seal is mounted on the core structure in a clearance fit from the outside end of the core structure, butting against the outside surface of the flange 620, and extending axially through a sleeve 625 and the seal section, where it is bonded to a seal 618, but ending short of the outer end 615. The pin may be secured to the tube by brazing the end of the tube to the pin, as indicated at 641, but in any case, the tube is hermetically sealed to the pin. Because the tube and core structure are brazed at only one end of the tube, the core structure and tube accommodate differences in their rates of expansion in an axial direction, and the clearance fit permits accommodation of differences in the rate of expansion in a radial direction. If the latter is not substantial, a close or even press fit can be used.

Figure 17:
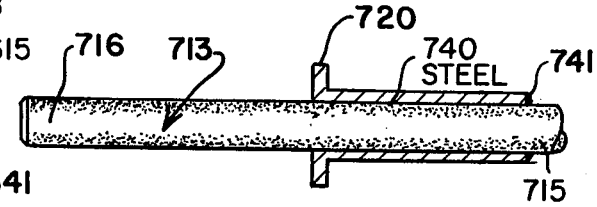
FIG. 17 is a fragmentary view in side elevation of a pin of still another embodiment.

In FIG. 17, a pin 713 is made up of a core structure of highly electrically conductive material, of uniform diameter from one end to the other, and a tube 740 of steel or the like with a flange 720 integral with its end. The tube 740 is positioned on the core structure so that the flange defines an outer end 715 and an inner end 716 of the pin. As in the pin 613, the tube 740 can be brazed to the core structure, as indicated at 741. Tne flange 720 has more strength in shear than the flange 620, because of the difference in metals of which they are made.

Figure 3:
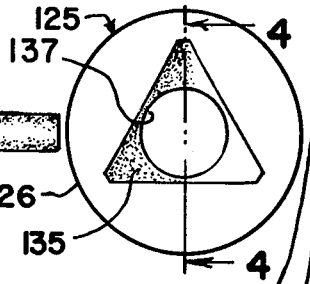
FIG. 3 is a view in end elevation, somewhat enlarged as compared with the views of the pin of FIGS. 1 and 2, of an insulating sleeve with a seat complementary to the flange of the pin of FIGS. 1 and 2.
Figure 4:
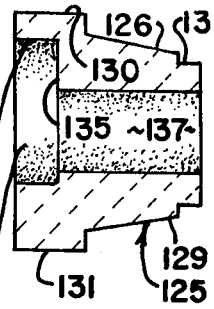
FIG. 4 is a sectional view taken along the line 4—4 of FIG. 3.
Figure 18:
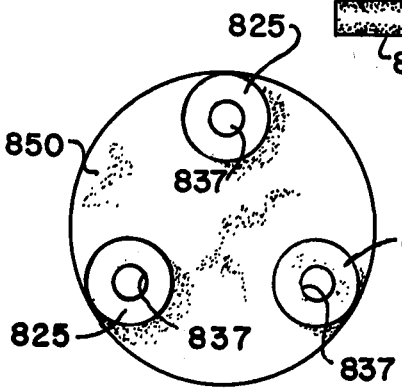
FIG. 18 is a bottom plan view of a unitary seal and web assembly of yet another embodiment.
Figure 20:
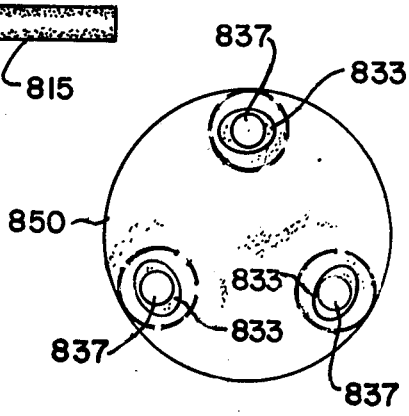
FIG. 20 is a top plan view of the seal and web assembly of FIG. 18.

FIGS. 18–20 illustrate an embodiment of this invention in which three openings 8 are provided in the bottom 3 of the cup-shaped body 2, each defined by a lip 9 with an inner, free edge 11. Three sleeves 825, of the same general external configuration as the sleeve 125 of the embodiment shown in FIGS. 3 and 4, are joined by a common web 850. Each of the sleeves has a seat 833 defined by an inner surface of a rim 831, and a flat radial surface through which a bore 837 opens. In this embodiment, the seat 833 is oval in plan, and receives an oval flange 820 of a pin 813. The pin has an inner end 816 and an outer end 815, the flange 820 being intermediate the two ends. As can be seen from FIG. 19, the web 850 and the sleeves integral with it are so constructed as to permit the web to fit inside the compass of the wall 4, and the sleeves 825 are so positioned as to seat simultaneously in the openings defined by the lips 9. The web 850 is shown larger in FIGS. 18 and 20, for illustration purposes, than it is in FIG. 19. The latter is in correct proportion with respect to the body 2. A reduced neck 817 is, in this embodiment, positioned immediately adjacent the outside surface of the seal 18, on the outside end 815 of the pin.

Figure 21:
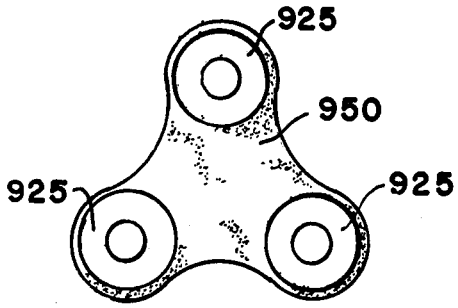
FIG. 21 is a bottom plan view of unitary seal and web assembly of yet another embodiment.
Figure 22:
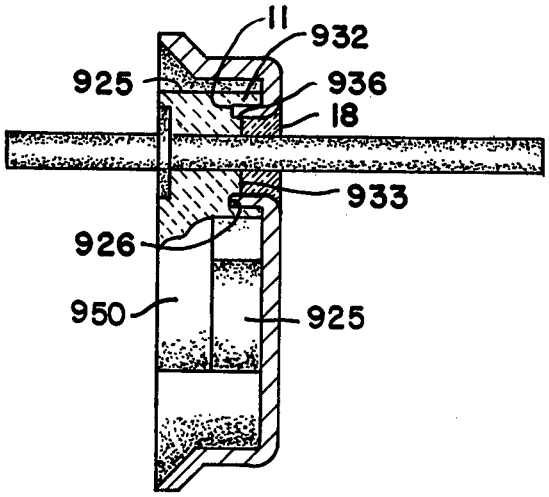
FIG. 22 is a view, partly in section and partly broken away, of a hermetic refrigeration terminal employing the unitary seal and web assembly of FIG. 21.

The embodiment shown in FIGS. 21 and 22 is similar to the one shown in FIGS. 18–20, except that the web joining sleeves 925 is in the form of a spider 950, and instead of the exterior wall of the sleeve being tapered, it is cylindrical and forms a skirt 932 embracing the outer surface of the lip, while a nose 933 extends into the opening 8, the free edge 11 of the lip seats in an annular, axially extending groove 926 defined by an outside wall 936 of the nose 933 and inside surface of the skirt 932. In both the embodiments shown in FIGS. 18–22, the web is heavy and rigid.

Figure 23:
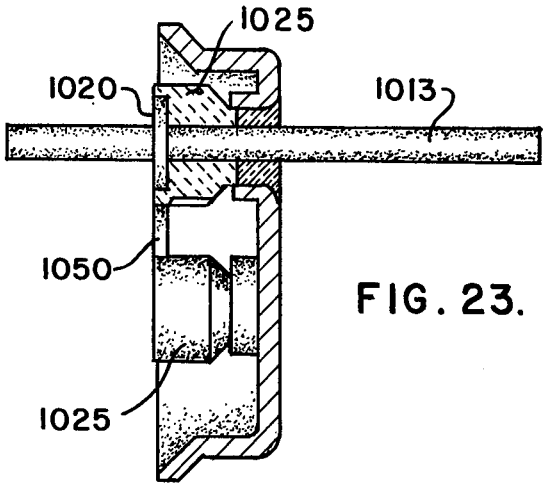
FIG. 23 is a diametric sectional view of another embodiment, showing still another unitary seal and web assembly.

In the embodiment shown in FIG. 23, sleeves 1025 are joined by a thin web 1050, which will fracture under load. A straight pin 1013, with a planar, circular flange 1020, is seated in each sleeve.

Figure 25:
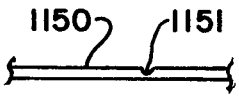
FIG. 25 is a fragmentary view in side elevation of the seal and web assembly of FIG. 24, viewed along the line 25—25 of FIG. 24.
Figure 24:
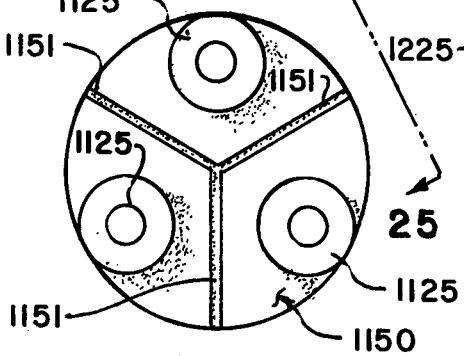
FIG. 24 is a bottom plan view of a unitary seal and web assembly of another embodiment.

In FIGS. 24 and 25, sleeves 1125 are joined by a common web 1150, which on its bottom (dish bottom-facing) surface, is provided with zones of weakness in the form of score lines 1151 to permit selective fracturing of the web. In both the embodiment shown in FIG. 23, and that in FIGS. 24 and 25, the provision for fracture of the web is made to permit the web to break if the contraction of the body 2 is greater than the contraction of the web after a glass seal has been fused to the pin and inside surface of the lip.

Figure 26:
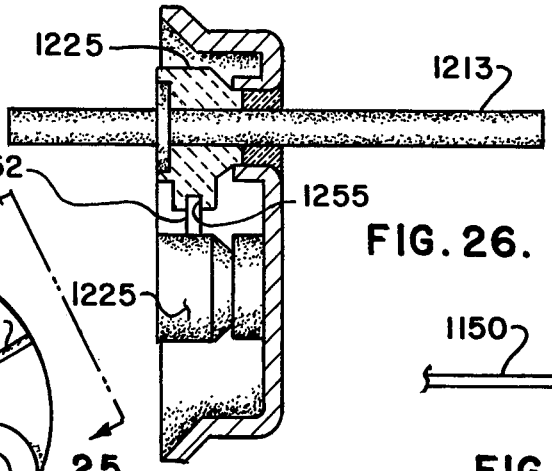
FIG. 26 is a diametric sectional view of another embodiment of a hermetic refrigeraton terminal utilizing another sleeve and web assembly of this invention.
Figure 27:
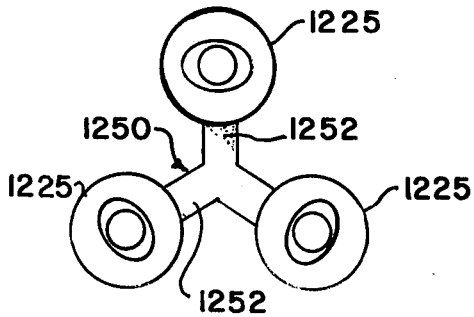
FIG. 27 is a view in top plan of the sleeve and web assembly of FIG. 26.

In the embodiment shown in FIGS. 26 and 27, sleeves 1225, of the general type shown in FIG. 23, accommodating pins 1213, have a channel-defining boss 1255 extending tangentially along a cylindrical side wall. A Y-shaped spider 1250 has legs 1252, the ends of which fit tightly into the channel of the boss 1255. The spider can be made of a plastic or other relatively flexible material as compared with ceramic of which the sleeves and integral webs of the previously described embodiments have been made. The spider 1250 is sufficiently stiff to position the sleeves properly, but sufficiently flexible to accommodate the expansion and contraction of the body.

Figure 28:
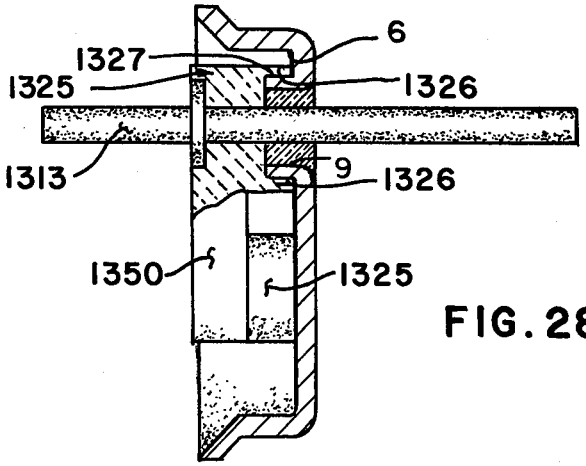
FIG. 28 is a diametric sectional view, partly broken away, of another embodiment of a hermetic refrigeration terminal utilizing another sleeve and web asembly.

The embodiment shown in FIG. 28 is substantially the same as that shown in FIG. 22 except that the nose 933 of the sleeve is eliminated. In this embodiment, sleeves 1325 have a skirt 1326 embracing an outer wall 1327 of the lip 9. The skirt 1326 extends to the surface 6 of the body. As in the other embodiments, a pin 1313 is mounted in each sleeve and bonded to the sleeve and lip by a seal of glass or the like. In this embodiment, the sleeves 1325 are connected by a web 1350 integral with the sleeves.

Numerous variations in the construction of the terminal of this invention, within the scope of the appended claims, will occur to those skilled in the art in the light of the foregoing disclosure. Merely by way of example, any kind of flange, integral or mounted, and of any shape, can be employed with the pin with the enlarged section, such as the one shown in FIG. 5; the particular kinds of flanges shown in some of the embodiments of pin can be applied to pins of different configurations, such as the necked pin of FIG. 14; other undulating configurations of the flange besides the prismatic one of the embodiment of FIGS. 7–11 can be employed to aid in orienting the pin when it is installed, and unsymmetrical non-circular shapes may be employed if only one orientation is desired; the sleeves of the embodiments of FIGS. 18–28 can have seats to accommodate and employ pins with various configurations of flange and bores to accommodate various seal area configurations, although, as has been indicated, the use of non-circular flanges and complementary seats with such web and sleeve assemblies has advantages in automatically orienting the pins with respect to the terminal so as to facilitate positioning of connector tabs and the like; the highly conductive pins of the embodiments of FIGS. 16 and 17 can be provided with necked areas within or outside of the tube, and any of the pins can be necked at other positions, as within the seal area, for example; as has been indicated, the coating, which can be applied by plating or otherwise, can be of a material more resistant to corrosion than the pin, instead of, or as well as, more electrically conductive, and other configurations of web, other materials, and other means of forming zones of weakness can be employed. These are merely illustrative.

We claim:

1. In a hermetic refrigeration terminal having a cup-shaped body with generally flat bottom and at least one opening in said bottom defined by an annular sealing lip, a current conducting pin extending through said opening and beyond said lip on both ends thereof, the inner end of said pin being on the dish side and the outer end of said pin being on the outer side of said body, seal bonding said pin to an inside surface of said lip, a flange extending generally radially from said pin and located axially between said lip and said inner end of said pin, and a sleeve surrounding said pin and extending axially between said flange and said lip, said sleeve being at least in part larger in diameter than said opening, said sleeve being bonded at its end opposite the flange to said seal, the improvement comprising said flange being non-circular and said sleeve being provided with a seat shaped complementarily to said flange and receiving said flange in a particular orientation, said pin being enlarged in transverse cross-sectional area through the axial reach of the seal by which it is bonded to said lip, relative to the cross-sectional area of the inner and outer ends beyond the said enlarged section, and the pin being coated with a material different from said pin beyond the reach of said seal, said pin being made of a core of electrically conductive metal of high coefficient of expansion compared with said seal and a tube of material with a coefficient of expansion less different from said seal than that of said core, said tube embracing said core and extending through the reach of said seal, and being secured hermetically tightly to said core, said tube having a flange, seated in said seat and constituting the pin flange.

2. In a hermetic refrigeration terminal having a cup-shaped body with a generally flat bottom and a plurality of openings in said bottom each defined by an annular sealing lip, there being at each opening a current conducting pin extending through said opening and beyond said lip on both ends thereof, the inner end of said pin being on the dish side and the outer end of said pin being on the outer side of said body, a seal bonding said pin to an inside surface of said lip, a flange extending generally radially from said pin and located axially between said lip and said inner end of said pin, and a sleeve surrounding said pin and extending axially between said flange and said lip, said sleeve being at least in part larger in diameter than said opening, said sleeve being bonded at its end opposite the flange to said seal, the improvement comprising each flange being non-circular and each sleeve being provided with a seat shaped complementarily to its associated flange and receiving its associated flange in a particular orientation,

3. The terminal of claim 2 wherein said common web is provided with zones of weakness between said sleeves.

4. In a hermetic refrigeration terminal having a cup-shaped body with a generally flat bottom and a plurality of openings in said bottom each defined by an annular sealing lip, there being at each opening a current conducting pin extending through said opening and beyond said lip on both ends thereof, the inner end of said pin being on the dish side and the outer end of said pin being on the outer side of said body, a seal bonding said pin to an inside surface of said lip, a flange extending generally radially from said pin and located axially between said lip and said inner and of said pin, and a sleeve surrounding said pin and extending axially between said flange and said lip, said sleeve being at least in part larger in diameter than said opening, said sleeve being bonded at its end opposite the flange to said seal, the improvement comprising each pin being coated beyond the part of its reach in which it is bonded to its respective seal with a material different from said pin, each pin being enlarged in transverse cross-sectional area through the axial reach in which it is bonded to its respective seal relative to the cross-sectional area of the inner and outer ends beyond the reach of said enlarged part, and all of said sleeves being joined by a common web.

5. The terminal of claim 4 wherein each said flange is non-circular.

6. In a hermetic refrigeration terminal having a cup-shaped body with a generally flat bottom and a plurality of openings in said bottom each defined by an annular sealing lip, there being at each opening a current conducting pin extending through said opening and beyond said lip on both ends thereof, the inner end of said pin being on the dish side and the outer end of said pin being on the outer side of said body, seal bonding said pin to an inside surface of said lip, a flange extending generally radially from said pin and located axially between said lip and said inner end of said pin, and a sleeve surrounding said pin and extending axially between said flange and said lip, said sleeve being at least in part larger in diameter than said opening, said sleeve being bonded at its end opposite the flange to said seal, the improvement comprising all of said sleeves being joined by a common web.

7. The terminal of claim 6 wherein each sleeve is provided with a non-circular seat in its surface facing a flange, and each flange is shaped and sized complementarily to seat in its respective seat.

8. The terminal of claim 6 comprising each pin being coated beyond the part of its reach in which it is bonded to its respective seal with a material different from the pin, each pin being enlarged in transverse cross-sectional area through the axial reach in which it is bonded to the respective seal relative to the cross-sectional area of the inner and outer ends beyond the reach of its enlarged part.

9. In a hermetic refrigeration terminal having a cup-shaped body with a generally flat bottom and at least one opening in said bottom defined by an annular sealing lip, a current conducting pin extending through said opening and beyond said lip on both ends thereof, the inner end of said pin being on the dish side and the outer end of said pin being on the outer side of said body, a seal bonding said pin to an inside surface of said lip, a flange extending generally radially from said pin and located axially between said lip and said inner end of said pin, and a sleeve surrounding said pin and extending axially between said flange and said lip, said sleeve being at least in part larger in diameter than said opening, said sleeve being bonded at its end opposite the flange to said seal, the improvement comprising said flange being non-circular and said sleeve being provided with a seat shaped complementarily to said flange and receiving said flange in a particular orientation, said pin being made of a core of electrically conductive metal of high coefficient of expansion compared with said seal and a tube of material with coefficient of expansion less different from said seal than that of said core, said tube embracing said core and extending through the reach of said seal, and being secured hermetically tightly to said core, said tube having a flange, seated in said seat and constituting the pin flange.

* * * * *

UNITED STATES PATENT AND TRADEMARK OFFICE

CERTIFICATE OF CORRECTION

PATENT NO. : 4,461,925

DATED : July 24, 1984

INVENTOR(S) : Benjamin Bowsky and Glann A. Honkomp

It is certified that error appears in the above-identified patent and that said Letters Patent are hereby corrected as shown below:

First page under "Inventors:" "Honkamp" should be --Honkomp--.

Column 3, line 2 "refrigeraton" should be --refrigeration--.

Claim 2, column 7, line 45, after "orientation," add --all of said sleeves being joined by a common web.--

Signed and Sealed this

*Nineteenth* Day of *February 1985*

[SEAL]

*Attest:*

DONALD J. QUIGG

*Attesting Officer*

*Acting Commissioner of Patents and Trademarks*